United States Patent [19]

Mitushashi

[11] 4,379,825

[45] Apr. 12, 1983

[54] POROUS ELECTROPHOTOGRAPHIC TONER AND PREPARATION PROCESS OF MAKING

[75] Inventor: Yasuo Mitushashi, Yokohama, Japan

[73] Assignee: Canon Kabushiki Kaisha, Tokyo, Japan

[21] Appl. No.: 233,288

[22] Filed: Feb. 10, 1981

[30] Foreign Application Priority Data

| | | | |
|---|---|---|---|
| Feb. 14, 1980 | [JP] | Japan | 55-16998 |
| Dec. 23, 1980 | [JP] | Japan | 55-183134 |
| Dec. 23, 1980 | [JP] | Japan | 55-183135 |

[51] Int. Cl.[3] ..... G03G 9/16

[52] U.S. Cl. ..... 430/111; 430/137; 430/98; 430/109; 264/49; 264/344; 264/5

[58] Field of Search ..... 264/49, 344; 430/137, 430/111

[56] References Cited

U.S. PATENT DOCUMENTS

| | | | |
|---|---|---|---|
| 3,925,219 | 12/1975 | Strong | 430/111 X |
| 3,956,020 | 8/1976 | Weininger et al. | 264/49 X |
| 3,970,571 | 7/1976 | Olson et al. | 430/137 |
| 4,041,115 | 8/1977 | Jenkins | 264/49 X |

*Primary Examiner*—John D. Welsh

*Attorney, Agent, or Firm*—Fitzpatrick, Cella, Harper & Scinto

[57] ABSTRACT

Porous toner comprises a coloring matter and a binder, said toner being formed by obtaining a powder through a step of mixing and kneading under heat a toner preparing material including a coloring matter, binder and elimination compound which neither softens or melts at a temperature at which said binder softens or melts, and by treating said powder with a solvent to remove said elimination compound.

12 Claims, 1 Drawing Figure

POROUS ELECTROPHOTOGRAPHIC TONER AND PREPARATION PROCESS OF MAKING

BACKGROUND OF THE INVENTION

1. Field of the Invention

This invention relates to a developing toner for use in developing an electric or magnetic latent image in the electrophotographic method, electrostatic printing method, or magnetic recording method.

2. Description of Prior Arts

For the toner to develop an electric or magnetic latent image, there have generally been used so far pulverized material having a particle size of from 5 to 20 microns or so prepared by mixing and kneading under a molten condition a binding resin such as polystyrene, a coloring matter such as carbon black, and depending on necessity, an additive, followed by pulverizing the mixture. Such dry-type toner is generally manufactured by a dry method which uses on solvent. On the other hand, a wet method, which utilizes a solvent as in a micro-capsule toner which has been actively studied in recent years, is seldom used for the reasons that manufacturing steps such as dissolution into the solvent, recovery of the solvent, etc. become complicated, that the toner having a particularly superior capability to that obtained by the dry-type is difficult to be manufactured, and others, hence this method is scarcely used at present.

In recent years, an image fixing system using a pressure-applying roller has been developed strenuously from the energy-saving standpoint, in accompaniment of which development of the toner having a pressure-fixing property is becoming an important subject. However, the toner, at the present stage, requires a linear pressure as high as 30 kg/cm or so between pressure rollers in order to provide a satisfactory image, and application of such high pressure brings about various troubles such as curling, lustering, wrinkling, etc. in an image bearing member, and also necessitates rigidness in the fixing device, which inevitably leads to increase in size of the apparatus and its manufacturing cost. On account of this, development of a toner has been eagerly desired which is capable of being fixed at as low a pressure as possible. That is, when a soft material such as, for example, polyethylene wax, etc. of a low molecular weight is used, a low pressure fixable toner can be obtained. However, various problems still remain with such toner. For example, in case the copying operation is continuously done on paper having different sizes, i.e., when the copying is to be done on paper having a narrow width, after which it is done on paper having a broad width, the toner on a portion which did not participate in copying on the paper having narrow width deteriorates to bring about lowered image density, and further causes agglomeration and caking of the toner particles during the development, and insufficient cleaning.

Heretofore, there has been proposed a method, in which emulsified small particles are together formed into size-enlarged particles to provide a void structure among the small particles so that the pressure fixing property of the toner is improved due to fragility of the void structure (vide: laid-open Japanese patent application No. 53-48740). This proposed method is disadvantageous in that the toner having stable particle size, strength, and porosity is difficult to obtain. Further, developing property of the toner is apt to be subjected to influence of humidity due to residual surfactant.

British Patent Specification No. 1192920 also discloses a method for producing granular ink having voids therein, which method is to remove a soluble solid substance from a spherical ink product obtained by spray-dry method with use of a solvent. However, with the spray-dry method, kind of binding resins applicable for the purpose is limited. Moreover, the spray-dry method is not suitable, in particular, for a pressure fixing substance such as ethylene type polymers, etc. Furthermore, with the spray-dry method, the produce assumes a true spherical shape, on account of which its pressure-fixing property is very poor, even if the soluble solid substance is removed from the product. In addition, with the spray-dry method, when a component insoluble in the solvent (e.g. elimination compound as explained later is insoluble in the solvent for the spray-dry method is present in a large quantity, various problems would inevitably arise such that adequate size distribution, shape, and composition of the toner particles are difficult to be obtained, and the void structure and porosity of the porous toner are difficult to be controlled, because difficult to be obtained the void structure tends to be readily formed by evaporation of the solvent at the time of the spray-drying.

SUMMARY OF THE INVENTION

It is an object of the present invention to provide a porous toner.

It is another object of the present invention to provide a porous toner capable of being fixed by a low pressure application.

It is a further object of the present invention to provide a porous toner having excellent developing characteristics.

It is still another object of the present invention to provide a porous toner having excellent cleaning characteristics.

It is a still further object of the present invention to provide a porous toner which causes neither agglomeration nor caking during image development or storage.

It is still another object of the present invention to provide a porous toner which can be produced with a high yield and at low production cost since a pressure-fixing substance contained in the toner components is hardly adhered to the toner producing machinery during toner production.

According to a general aspect of the present invention, there is provided a porous toner which comprises a coloring matter and a binder, said toner being formed by obtaining a powder through a step of mixing and kneading under heat a toner preparing material including a coloring matter, binder and elimination compound which neither softens or melts at a temperature at which said binder softens or melts, and by treating said powder with a solvent to remove said elimination compound.

According to another aspect of the present invention, there is provided a porous toner which comprises a coloring matter and a binder, said toner being formed by mixing and kneading under heat a toner preparing material including a coloring matter, binder and elimination compound which neither softens nor melts at a temperature at which said binder softens or melts, then finely dividing the mixture to form powder, and thereafter applying heat treatment to the powder, followed by treating the powder with a solvent to remove said elimination compound.

According to further aspect of the present invention, there is provided a porous toner which comprises a coloring matter and a binder, said toner being formed by mixing and kneading under heat a toner preparing material including a coloring matter, binder and elimination compound which neither softens nor melts at a temperature at which said binder softens or melts, then finely dividing the mixture to form powder, and treating the powder with a solvent to remove said elimination compound, followed by applying heat treatment to the powder.

BRIEF DESCRIPTION OF THE DRAWINGS

Single

DESCRIPTION OF THE PREFERRED EMBODIMENTS

Figure 1:
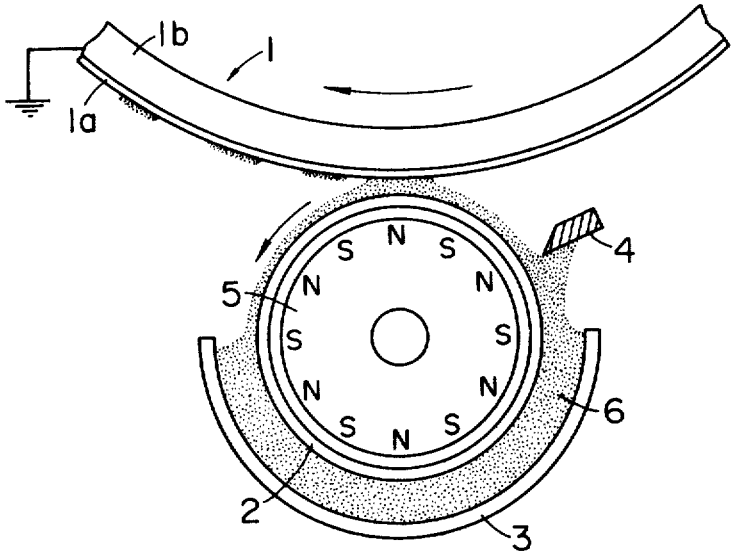
FIG. 1 is a schematic cross-sectional view of a developing device which uses a magnetic developer.

The toner according to the present invention is in powder form, a soluble portion of which is removed by a solvent such as water and various solvents. Its surface is remarkably irregular, and its interior also has voids or pores. Such structure seemingly imparts favorable influence to its pressure fixing property and developing property as well. That is, as to its pressure fixing property, the porous structure of the toner particles in both surface and interior contributes to their brittleness or fragility, on account of which the toner particles are more readily crushed by pressure-application from outside than those not having such porous structure, thereby providing satisfactory fixing property. On the other hand, as to its developing property, it is assumed that largeness in the surface area of the toner particles makes it possible to retain sufficient frictional charge, whereby stable development is possible. It is further assumed that the powder material subjected to heat-treatment has smooth surface, which remarkably improves fluidity of the toner particles, whereby its developing property further stabilizes, its durability further improves, and its cleaning characteristic improves as well.

In the present invention, the elimination compound is soluble in a particular solvent, and serves to form pores in the surface of the toner particles and to form porous structure in the interior of the toner particles by removing the elimination compound with a particular solvent after the powder material is formed from the same along with the coloring material etc.

The solvent to be used in dissolving the elimination compound is required not to dissolve other components in the toner, particularly, the binding substance. Depending on the kind of the binding substance, there may be used the following solvents: water, aqueous solvents such as hydrochloric acid, sulfuric acid, nitric acid, aqueous solution of caustic soda, aqueous solution of caustic potash, ammonia water and the like, and organic solvents such as alcohols, ethers, aliphatic hydrocarbons, aromatic hydrocarbons, halogenated hydrocarbons, ketones and the like.

The elimination compound to be removed with the above-listed solvents can be selected from those as enumerated below: oil-soluble dyes such as C.I.26150, C.I.50415, C.I.74350; dispersion dyes such as C.I.Disperse Blue 56, C.I.Disperse Red 73; basic dyes such as C.I.44045, C.I.51005; acidic dyes such as C.I.Acid Black 63, C.I.Acid Blue 25; organic and inorganic salts such as cobalt complex of ethylenediamine tetraacetic acid, chromium complex of bis-ditertiary-butylsalycylic acid, tertiray butyl ammonium, sodium chloride, sodium carbonate, calcium carbonate; and products of natuer such as saccharose starch, etc. These elimination compounds should be soluble in the abovementioned solvents, and preferably be well compatible with or dispersible in other components of the toner.

The weight ratio of the elimination compound in the powdery material ranges from 10 to 90%, or more preferably from 20 to 80%, or optimumly from 25 to 60%. The powdery material containing the elimination compound in the abovementioned ratio is caused to contact with the solvent. It is to be noted that, by changing the content and kind of the elimination compound, the porosity in the toner particles can be readily controlled.

As the coloring matter to be used in the present invention, those well known dyes and pigments are used. They are carbon black, iron black, phthalocyanine blue, Prussion blue, quinacrodone, benzidine yellow, and so on.

As the binding substance insoluble in the solvent for use in the present invention, those which can readily adhere to fibers containing paper upon application of a pressure are suitable. Particularly preferable binding materials are, for example, ethylene type olefin polymers having a melt viscosity of from 10 to $10^6$ cps at 140° C. such as polyethylene, polypropylene, copolymers of ethylene and propylene, ethylene-acryl type copolymers, ethylene-vinyl acetate copolymers and the like; rubbers such as styrene-butadiene copolymer, styrene-isoprene copolymer and the like; elastomers such as polyurethane elastomer, saturated linear polyester and the like; fatty acids such as stearic acis, oleic acid, myristic acid, stearic acid amide, oleic acid amide, zinc stearate and the like as well as their derivatives; and waves such as paraffin wax, carnauba wax and the like. In addition, as the binding resins, there may be added well known polymers besides the abovementioned pressure fixing binding substances, provided that its quantity should not exceed the quantity of the abovementioned pressure fixing binding substance.

The toner of the present invention may be formed into a magnetic toner by incorporating into the toner component magnetic powders which have heretofore been known as the magnetic material. Such material may include, typically ferro-magnetic elements, and alloys and compounds containing such elements, for example alloys and compounds containing iron, cobalt, nickel, manganese, etc. such as magnetite, hematite, ferrite, etc., and other ferro-magnetic alloys etc. Some of the materials may also serve as the coloring matter. The magnetic powders may be contained in the porous toner in an amount of from 15 to 70 weight %, or more preferably from 20 to 50 weight %.

Further, for the purpose of controlling electric charge, and preventing agglomeration of the toner particles, there may be added carbon black, nigrosine, metal complex salts, colloidal silica powder, fluorine-containing resin powder, etc.

The concrete method for producing the toner according to the present invention will be described with reference to several preferred examples. As one example, the components for preparation of the toner such as the elimination compound, binding substance, and coloring matter are premixed, then they are mixed and kneaded by melting under heat with use of roll mill or other appropriate means, and the mixture is thereafter pulverized into powdery material having a particle size range of from 1 to 50 microns or so. This powdery material is immersed in a solvent which dissolves the elimination compound, but does not dissolve the binding material and coloring matter, thereby dissolving a part or a substantially entire part of the elimination compound in the solvent, and removing the compound from the powdery material. The powdery material remaining after removal of the elimination compound is washed with water, alcohol, organic solvent, etc., then dried by the spray-drying operation, and finally subjected to classification of particle size distribution of from approximately 5 to 35 microns.

Heat-treatment may be further added to the above-mentioned process steps. In this case, the powdery material is heated by a fluidized layer type dryer either before or after removal of the elimination compound from the powdery material. The heating temperature at this instant should be above a temperatuer, at which the binding substance in the toner softens or melts (or more preferably a temperature higher by 20° C. than that of softening or melting of the binding substance). It should, however, be noted that, when the temperature is too high, the toner components are modified (e.g. oxidation of the magnetic powder, etc.), hence the heating should preferably be done at a temperature of 250° C. or below, or more preferably at 220° C. or below. In particular, when the heat-treatment is to be done after removal of the elimination compound, it should be done in such a manner that irregular structure in both surface and interior of the toner particles may not be crushed.

In the present invention, the elimination compound should preferably be such that it neither softens nor melts at a temperature at which the binding substance softens or melts, and that its particle size distribution should be in as narrow a range as possible, i.e., ranging from 0.01 to 20 microns, or more preferably from 0.05 to 10 microns, or so. The reason for this is that in the dry type method, in general, it is common to conduct the kneading step at a softening or melting temperature of the binding substance. For example, if the elimination compound is softened at a softening temperature of the binding substance, carbon black, iron black and other coloring matters are dispersed in the elimination compound. When the toner containing such elimination compound is immersed in the solvent, the elimination compound is dissolved to result in dispersion into the solvent of the coloring matter which has been dispersed in the elimination compound, whereby there arises a state, in which a considerable amount of individual coloring matter is deposited to the surface of the powdery material or mixed in the material after drying. While it is possible to eliminate such individual coloring matter in the classification step, the operation should be done for a plurality of numbers of times with utmost of care, which is extremely unfavorable from the point of the production efficiency.

Furthermore, in the present invention, since the elimination compound does not soften at a softening temperature of the binding substance, the compound acts as the viscosity increasing agent in the step of dispersing or dissolving the coloring matter by melting the binding substance to improve dispersion of the coloring matter in the binding substance, whereby the toner of a uniform composition is obtained, and the developing property thereof becomes satisfactory. Further, in an ordinary method of obtaining fine powder material by mechanical crushing, the pressure fixing substance tends to readily stick to a collision plate, etc. within the crusher. In the method according to the present invention, however, since a solvent-soluble compound which is not required to contribute to the pressure fixing property of the toner is used in mixture, such sticking phenomenon is difficult to take place. Moreover, in the method of the present invention, the solvent, the substances dissolved in the solvent, and other raw materials can be re-used, which is desirable from the standpoint of the resources-saving and the waste material pollution prevention.

The toner according to the present invention is applicable to various developing methods. For example, it is applicable to the magnetic brush developing method, the cascade developing method, the impression developing method, the method using an electrically conductive magnetic toner as disclosed in U.S. Pat. No. 3,909,258 specification, the method using a high resistance magnetic toner as disclosed in laid-open Japanese Patent Application No. 53-336636, the methods using insulative magnetic toner as disclosed in laid-open Japanese patent applications No. 54-42141, No. 55-18656, etc., the fur brush developing method, the powder clouding method, and others.

EXAMPLE 1

The following ingredients are mixed by a ball mill, and then melted to 140° C. and kneaded by a roll mill.

| Ingredient | Part by Weight |
|---|---|
| Polyethylene having melt-viscosity of approx. 120 cps at 140° C. | 100 |
| Magnetic powder ($Fe_3O_4$ having an average particle diameter of approx. 0.3 microns) | 80 |
| Metal complex dye (trade-name "Zapon Fast Black B", C.I. Acid Black 63, a product of BASF, having particle size of approx. 2 microns) | 100 |

The melting point of the metal complex dye is 150° C. and above, hence it does not melt at this stage. After cooling, the mixture is roughly crushed by a hammer mill, followed by pulverization with a jet crusher to obtain powder material of about 1 to 50 microns in particle diameter. 100 parts by weight of this powder material is immersed in 2,000 parts by weight of methyl-ethyl ketone to dissolve the dyestuff, after which the solution is filtered, and the residue is washed and dried in an oven at 50° C. The thus obtained powder material is in an amount of approximately 70 parts by weight, from which about 83% of the dyestuff has been eliminated. Subsequently, the powder material is classified by a classifying apparatus to select a particle size distribution of from 5 to 35 microns, which is made the toner. Further 100 parts by weight of this toner is mixed with 0.5 part by weight of hydrophobic colloidal silica to prepare a developing agent.

An electric latent image is formed on the surface of an insulative layer of a photosensitive drum consisting of three layers, i.e., an insulative layer of a polyester resin, a photosensitive layer made of CdS and acrylic resin, and an electrically conductive substrate, by subjecting it to uniform charging with a corona discharge of +6 KV at a linear surface speed of 168 mm/sec. of the drum, subsequently irradiating an image original and applying a.c. corona discharge of 7 KV simultaneously, and thereafter subjecting the drum surface to an overall uniform exposure.

This latent image is developed by using the abovedescribed developing agent in a sleeve-rotating-and-magnet-fixed type developing device as shown in FIG. 1 (the peripheral speed of the sleeve is the same as that of the photosensitive drum, but its rotation direction is opposite).

This developing device is provided with a rotational sleeve having a diameter of 50 mm, a magnetic flux density of 700 gausses on its surface, and a distance of 0.3 mm between its surface and an ear-cutting blade. The sleeve and the abovementioned photosensitive drum are arranged so that the distance between the sleeve surface and drum surface is 0.25 mm. To the sleeve surface, an alternating current bias of 200 Hz and 600 V is applied, and the latent image is developed with the developer. Subsequently, a d.c. corona of +7 KV is applied from the back surface of the image transfer paper to transfer the toner image to the paper, thereby obtaining a reproduced image. The image as transferred is fixed by passing the same through rollers with a linear pressure of 10 kg/cm being applied thereto. A clear image free from fogging can be obtained. The image fixing property is extremely good and, even when the image is vigorously rubbed, it does not peel off substantially. Further, a durability test for 10,000 sheets is conducted. As the result, a clear image is obtained, even after the 10,000th sheet, with good image fixing property.

In FIG. 1, a reference numeral 1 designates the photosensitive drum, wherein an electrically conductive metal drum 1*a* provided on its peripheral surface with a photosensitive member 1*b* is electrically grounded. The drum 1 is rotated in an arrowed direction at a constant speed. A number 2 refers to a cylindrical sleeve for holding and conveying the developer, while simultaneously imparting electric charge to the developer particles. The sleeve rotates in an arrow direction as shown in the drawing at the same speed as that of the photosensitive drum 1. By rotation of the cylindrical sleeve 2, the developer is conveyed to a developing section, while being imparted the electric charge. A reference numeral 3 designates a container for receiving and accommodating therein the one-component, insulative magnetic toner 6 as the developer. The vessel is so disposed that the developer therein may be contacted to the surface of the cylindrical sleeve 2. A reference numeral 4 designates an iron blade, which is disposed in confrontation to the cylindrical sleeve 2 with a small space gap being provided therebetween. The blade 4 is to regulate the quantity of the developer moving on the cylindrical sleeve 2 toward the developing section. A numeral 5 refers to a multi-polar magnet rolls (in the illustrated example, 12 magnetic poles are provided), which is in a fixed condition.

COMPARATIVE EXAMPLE 1

The following ingredients are mixed by a ball mill, and then melted and kneaded by a roll mill.

| Ingredient | Part by Weight |
|---|---|
| Polyethylene having melt-viscosity of approx. 120 cps at 140° C. | 100 |
| Magnetic powder ($Fe_3O_4$ having an average particle diameter of approx. 0.3 micron) | 80 |
| Metal complex dye | 17 |

-continued

| Ingredient | Part by Weight |
|---|---|
| used in Example 1 | |

After cooling, the mixture is roughly crushed by a hammer mill, followed by pulverization with a jet crusher. During the pulverization, there takes place sticking of the toner around the collision wall of the jet crusher. The thus obtained powder material is classified by a classifying apparatus to select a particle size distribution of from 5 to 35 microns, which is made the toner. 100 parts by weight of this toner is mixed with 0.5 part by weight of hydrophobic colloidal silica to prepare a developing agent.

Using this developing agent, image development is conducted in the same manner as in Example 1 above, and the image is fixed by passing the same through image fixing rollers, to which a linear pressure of 10 kg/cm is applied. Although the image obtained is found to be clear and free from fogging, its fixing property is extremely poor. Durability test for 10,000 sheets reveals remarkable decrease in the image density, hence poor image quality.

EXAMPLE 2

Toner is prepared in the substantially same manner as in Example 1 above by use of the following ingredients with the exception that the melting and kneading is conducted at 145° C., at which the dyestuff does not melt.

| Ingredient | Part by Weight |
|---|---|
| Polyethylene having melt-viscosity of approx. 120 cps at 140° C. | 80 |
| Polyethylene having melt-viscosity of approx. 30,000 cps at 140° C. | 20 |
| Magnetic powder (ferrite powder having an average particle diameter of approx. 0.2 micron) | 60 |
| Carbon black | 5 |
| Dyestuff ("Oil Blue #15 - C.I.74350" tradename for a product of Yamamoto, Chemical Co. Ltd., Japan) having an average particle size of approx. 1 micron | 120 |

100 parts by weight of this toner is mixed with 0.7 part by weight of hydrophobic colloidal silica to prepare a developing agent.

Using this developer, image development is conducted in the same manner as in Example 1 above, and the image is fixed by passing the same through image fixing rollers, to which a linear pressure of 10 kg/cm is applied. A clear image with satisfactory reproducibility of thin lines and free from fogging can be obtained. The image fixing property is extremely good, and the image is not peeled off even when it is vigorously rubbed.

EXAMPLE 3

The following ingredients are mixed by a ball mill, and then melted and kneaded by a roll mill at 145° C.

| Ingredient | Part by Weight |
|---|---|
| Polypropylene having melt-viscosity of approx. 400 cps at 140° C. | 50 |
| Polyethylene having melt-viscosity of approx. 120 cps at 140° C. | 50 |
| Magnetic powder ($Fe_3O_4$ having an average particle size of approx. 0.3 micron | 60 |
| Hydrophobic colloidal silica | 10 |
| Cobalt complex of ethylene diamine tetraacetate (particle size of approx. 0.8 micron, melting point of 150° C. and above) | 80 |

After cooling, the mixture is roughly crushed by a hammer mill, followed by pulverization with a jet crusher to obtain powder material of 1 to 50 microns in particle diameter. 100 parts by weight of this powder material is immersed in 2,000 parts by weight of water to dissolve the complex salt by shaking, after which the solution is filtered and the residue is washed, followed by further washing with methanol, and finally dried in an oven at 50° C. The thus obtained powder material is classified to select a particle size distribution of from 5 to 35 microns, which is made the toner. Further, 100 parts by weight of this toner is mixed with 0.8 part by weight of hydrophobic colloidal silica to be made the developing agent.

Using this developer, image development is conducted in the same manner as in Example 1 above, and the image is fixed by passing the same through image fixing rollers, to which a linear pressure of 15 kg/cm is applied. A clear image free from fogging can be obtained. The fixing property of the image is also extremely satisfactory.

EXAMPLE 4

The toner is prepared in the substantially same manner as in Example 1 above by use of the following components.

| Ingredient | Part by Weight |
|---|---|
| Paraffin | 30 |
| Polyethylene having melt-viscosity of 4,300 cps at 140° C. | 70 |
| Magnetic powder ($Fe_3O_4$ having an average particle size of 0.3 micron) | 100 |
| Hydrophobic colloidal silica | 15 |
| Dyestuff used in Example 1 | 100 |

100 parts by weight of this toner is mixed with 1.2 parts by weight of hydrophobic colloidal silica to be made the developing agent.

Using this developer, image development is conducted in the same manner as in Example 1 above, and the image is fixed by passing the same through image fixing rollers applied with a linear pressure of 10 kg/cm. A clear image free from fogging can be obtained. Its fixing property is also extremely favorable, i.e., the image is not peeled off even when it is vigorously rubbed.

EXAMPLE 5

The following components are mixed by a ball mill, and then melted and kneaded by a roll mill at 145° C.

| Ingredient | Part by Weight |
|---|---|
| Polyethylene having melt-viscosity of approx. 120 cps at 140° C. | 50 |
| Polyethylene having melt-viscosisty of approx. 30,000 cps at 140° C. | 50 |
| Carbon black | 10 |
| Sodium chloride (particle diameter of approx. 1 micron) | 100 |

During the melting and kneading, sodium chloride does not melt. After cooling, the mixture is coarsely crushed by a hammer mill, followed by pulverization with a jet crusher. 100 parts by weight of this powder material is immersed in 1,000 parts by weight of water to dissolve sodium chloride, after which the solution is filtered, and the residue is washed to remove sodium chloride and finally dried by a spray drier. The thus obtained powder material is classified to select a particle size range of from 5 to 20 microns, which is made the toner. 10 parts by weight of this toner is mixed with 0.05 part by weight of hydrophobic colloidal silica and 90 parts by weight of iron powder as a carrier ("EFV 250/400", tradename for a product of Nippon Teppun, K.K., Japan) to be made the developing agent.

By using this developing agent with a plain-paper electrophotographic reproduction apparatus ("NP-5000", a tradename for a product of Canon K.K., Japan) available in general market, there is obtained a non-fixed image. Then, this image is fixed by passing the same through image fixing rollers applied with a linear pressure of 10 kg/cm. As the result, a clear image with high image density is obtained, the image fixing property of which is extremely good.

EXAMPLE 6

The following components for the toner preparation are mixed by a Henschel type mixer, and then melted and kneaded by a roll mill.

| Ingredient | Part by Weight |
|---|---|
| Polyethylene having melt-viscosity of approx. 120 cps at 140° C. | 100 |
| Magnetic powder (triiron tetraoxide having an average particle size of 0.3 micron) | 70 |
| Metal complex salt dye ("Zapon Fast Black B - C.I. Acid Black 63", a tradename for a product of BASF) | 4 |
| Calcium carbonate (average particle size of 1.7 microns) | 200 |
| Hydrophobic colloidal silica | 10 |

After cooling, the mixture is coarsely crushed by use of a crush mill, followed by pulverization with an air jet crusher to obtain powder material having a particle size range of 1 to 30 microns. This powder material is subjected to heat-treatment in a hot air current flowing at a rate of 5 $m^3$/min. and having an inlet temperature of from 180° to 200° C. and an outlet temperature of from 100° to 120° C. by use of a spring drying machine fitted with a powder coating spray gun in place of an original liquid supplying nozzle. 100 parts by weight of the head-treated powder material is immersed in 1,000 parts by weight of 2 N hydrochloric acid, and, while vigorously agitating the batch with a homogenizer, calcium carbonate is extracted by dissolution and extraction. Thereafter, the solution is filtered, and the residue is washed well in water and dried in an oven at 50° C.

The thus obtained powder material is found to be free from calcium carbonate of 60% or higher in its content. Further, the powder material is subjected to classification by a cla-sifier to obtain the toner of a particle size range of from 5 to 30 microns. 100 parts by weight of this toner is mixed with 0.6 parts by weight of hydrophobic colloidal silica, thereby obtaining the developing agent.

The developing agent is used for image reproduction test in NP-200J reproduction apparatus (product of Canon K.K.) with the image fixing device removed therefrom. The reproduced image thus obtained is fixed by passing the same through image fixing rollers applied with a linear pressure of 10 kg/cm. The resulted image is clear and free from fogging. Its image fixing property is also extremely satisfactory, and substantially nothing peeled off even when the image is vigorously rubbed. Further, durability test for 20,000 sheets reveals that, even after reproduction of the predetermined number of sheet, clear images comparable with the initial reproduction can be obtained, and the image fixing property thereof also remains unchanged.

Furthermore, the image reproduction is first conducted for consecutive 1,000 sheets in B-4 size paper with the NP-200J reproduction apparatus (modified type), after which the reproduction is conducted on A-3 size paper. Substantially no lowering of the image density can be observed even at a portion of the toner where it has not been used up at the time of reproduction with the B-4 size paper.

COMPARATIVE EXAMPLE 2

The following ingredients are mixed, and further melted and kneaded to prepare a mixture.

| Ingredient | Part by Weight |
|---|---|
| Polyethylene having melt-index of 120 cps at 140° C. | 100 |
| Magnetic powder (triiron tetraoxide having an average particle size of 0.3 micron) | 70 |
| Dyestuff used in Example 6 | 4 |
| Hydrophobic colloidal silica | 10 |

After cooling, the mixture is coarsely crushed, followed by pulverization with a jet crusher. The thus obtained powder material is classified to obtain the toner of a particle size range of from about 5 to 30 microns. 100 parts by weight of this toner is mixed with 0.6 part by weight of hydrophobic colloidal silica to be made the developing agent.

Using this developer, an image is developed in the same manner as in Example 6, and then it is fixed by passing the same through image fixing rollers applied with a linear pressure of 10 kg/cm. Although a clear image free from fogging is obtained, its image fixing property is insufficient and the image peels off instantaneously upon slight rubbing with a finger. Durability test for 10,000 sheets reveals that the image density considerably lowers and the image quality becomes interior. On the other hand, continuous reproduction is conducted for 1,000 sheets of paper in B-4 size, and subsequently in A-3 size. It is found out that the portion of the toner which has not been used up in the reproduction with the B-4 size paper lowers its image density to approximately half or below that of the toner portion used up in the previous reproduction.

EXAMPLE 7

The toner is prepared in the substantially same manner as in Example 6 above by use of the following components with the exception that water is used as the solvent for extracting and removing sodium chloride.

| Ingredient | Part by Weight |
|---|---|
| Polyethylene having melt-viscosity of approx. 120 cps at 140° C. | 70 |
| Polyethylene having melt-viscosity of approx. 30,000 cps at 140° C. | 30 |
| Magnetic powder (ferrite powder having an average particle size of approx. 0.6 micron) | 60 |
| Carbon black | 5 |
| Dyestuff used in Example 6 | 2 |
| Sodium chloride having an average particle size of approx. 2 microns | 150 |

100 parts by weight of the toner thus obtained is mixed with 0.5 part by weight of hydrophobic colloidal silica, and the mixture is subjected to the same test as in Example 6 above. A reproduced image of a high quality is obtained with good image fixing property, i.e., no substantial peeling occurs even upon vigorous rubbing. Durability test for the reproduction operation also reveals excellent result.

EXAMPLE 8

Using the following ingredients, pulverized product is obtained in the substantially same manner as in Example 6

| Ingredient | Part by Weight |
|---|---|
| Polypropylene having melt-viscosity of approx. 400 cps at 140° C. | 50 |
| Polyethylene having melt-viscosity of approx. 120 cps at 140° C. | 50 |
| Magnetic powder (triiron tetraoxise having an average particle size of approx. 0.5 micron) | 80 |
| Hydrophobic colloidal silica | 10 |
| Dyestuff (same as that used in Example 6 having an average particle size of approx. 1 micron) | 100 |

The pulverized product is treated for 30 minutes in hot air blast at 150° C. using a fluidized layer type coating device. Subsequently, the dyestuff is exqracted and removed with toluene, followed by classification to be made the toner. Thereafter, the developing agent is prepared in the same manner as in Example 6, and subjected to the reproduction test. Satisfactory results can be obtained.

EXAMPLE 9

The toner is prepared in the substantially same manner as in Example 6 above by use of the following ingredients with the exception that water is used as the solvent for extracting and removing saccharose.

| Ingredient | Part by Weight |
|---|---|
| Polyethylene having melt-viscosity of approx. 420 cps at 140° C. | 60 |
| Cyclized rubber | 40 |
| Carbon black | 10 |
| Saccharose (average particle size of approx. 2 microns) | 100 |
| Dyestuff (same as that used in Example 6) | 4 |

10 parts by weight of the toner thus obtained is mixed with 0.3 part by weight of hydrophobic colloidal silica and 90 parts by weight of iron powder as a carrier ("EFV 250/400", product of Nippon Teppun K.K., Japan) to thereby obtain the developing agent. This developing agent is used with the developing device of a plain-paper electrophotographic reproduction apparatus ("NP-5000", a tradename for a product of Canon K.K., Japan) avaiable in general market, from which a non-fixed reproduced image is obtained. The image is then fixed by passing the same through image fixing rollers applied with a linear pressure of 15 kg/cm. A clear image excellent in reproducibility of thin lines is obtained with good image fixing property.

EXAMPLE 10

The following components for the toner preparation are mixed by a Henschel mixer, and then melted and kneaded by a roll mill.

| Ingredient | Part by Weight |
|---|---|
| Polyethylene having melt-viscosity of approx. 120 cps at 140° C. | 100 |
| Magnetic powder (triiron tetraoxide having an average particle size of 0.3 micron) | 70 |
| Metal complex dye ("Zapon Fast Black B", C.I. Acid Black 63, product of BASF) | 4 |
| Calcium carbonate (average particle size of 1.7 microns) | 200 |
| Hydrophobic colloidal silica | 10 |

After cooling, the mixture is coarsely crushed by use of a crush mill, followed by pulverization with an air jet crusher to obtain powder material having a particle size range of from 1 to 30 microns. 100 parts by weight of this pulverized product is immersed in 1,000 parts by weight of 2 N hydrochloric acid, and, while vigorously agitating the batch with a homogenizer, calcium carbonate is removed by dissolution and extraction. Thereafter, the solution is filtered, and the pulverized product is washed well in water and dried in an oven at 50° C.

The thus obtained powder material is found to be free from calcium carbonate of 60% or higher in its content. Further, the powder material is subjected to heat-treatment in a hot air current flowing at a rate of 5 $m^3$/min. and having an inlet temperature of 160° C. and an outlet temperature of 70° C. by use of a spray drying machine fitted with a powder coating spray gun in place of an original liquied supplying nozzle. The thus heat-treated powder material is classified to obtain the toner of a particle size range of from 5 to 30 microns. Then, 100 parts by weight of this toner is mixed with 0.6 part by weight of hydrophobic colloidal silica to prepare a developing agent.

The developing agent is used for development with "NP-200J" reproduction apparatus (product of Canon K.K., Japan). A non-fixed reproduced image obtained from this machine is then subjected to image fixing by passing the same through image fixing rollers applied with a linear pressure of 10 kg/cm. The resulted image is clear and free from fogging. Its image fixing property is also extremely good, and no substantial peeling of the image takes place even when it is rubbed vigorously. Durability test for 20,000 sheets of paper is conducted, which reveals that, after reproduction of the predetermined number of sheets, clear images comparable with the initial reproduction can be obtained, and the image fixing property also remains unchanged. Other problems such as sticking of the toner particles to the surface of the photosensitive drum due to insufficient cleaning do not take place.

Continuous reproduction for 1,000 sheets of B-4 size paper is first conducted, after which the reproduction is done on A-3 size paper. Substantially no discrease in the image density is observed at the toner portion where it has not been used up at the time of reproducing B-4 size paper.

EXAMPLE 11

The toner is prepared in the substantially same way as in Example 10 above using the following components with the exception that water is used as the solvent for extracting and removing sodium chloride.

| Ingredient | Part by Weight |
|---|---|
| Polyethylene having melt-viscosity of approx. 120 cps at 140° C. | 70 |
| Polyethylene having melt-viscosity of 30,000 cps at 140° C. | 30 |
| Magnetic powder (ferrite powder having average particle size of 0.6 micron) | 60 |
| Carbon black | 5 |
| Dyestuff (same as that used in Example 10) | 2 |
| Sodium chloride (average particle size of approx. 2 micron) | 150 |

Subsequently, 100 parts by weight of this toner is mixed with 0.5 part by weight of hydrophobic colloidal silica, and the thus obtained developing agent is subjected to the same test as the Example 10 above. A high quality reproduced image can be obtained. Its image fixing property is also satisfactory, and, even when the image is vigorously rubbed, substantially no peeling takes place. Further, the durability is also excellent.

EXAMPLE 12

Using the following ingredients, pulverized product is obtained in the substantially same manner as in Example 10.

| Ingredient | Part by Weight |
|---|---|
| Polypropylene having melt-viscosity of approx. 400 cps at 140° C. | 40 |
| Polyethylene having melt-viscosity of approx. 120 cps at 140° C. | 60 |
| Magnetic powder (triiron tetraoxide having an average particle size of approx. 0.5 micron) | 80 |
| Hydrophobic colloidal silica | 10 |
| Dyestuff (same as that used in Example 10 and having average particle diameter of approx. 1 micron) | 100 |

The pulverized product is immersed in toluene to extract and remove the dyestuff therefrom. After drying, the pulverized product is subjected to heat-treatment by the same method as in Example 10, followed by classification of the same to obtain the toner.

In the same manner as in Example 10 above, the developing agent is prepared and the thus obtained developing agent is subjected to test, as the result of which favorable results are obtained.

EXAMPLE 13

Using the following components, the toner is prepared in the substantially same manner as in Example 10 above, with the exception that water is used as the solvent for extracting and removing saccharose.

| Ingredient | Part by Weight |
|---|---|
| Polyethylene having melt-viscosity of approx. 420 cps at 140° C. | 60 |
| Cyclized rubber | 40 |
| Carbon black | 10 |
| Saccharose (average particle size of approx. 2 microns) | 100 |
| Dyestuff (same as that used in Example 10) | 4 |

10 parts by weight of this toner is mixed with 0.3 part by weight of hydrophobic colloidal silica and 90 parts by weight of carrier iron powder ("EFV 250/400", a product of Nippon Teppun K.K., Japan) to prepare a developing agent.

This developing agent is used with the developing device of a plain-paper electrophotographic reproduction apparatus ("NP-5000", product of Canon K.K., Japan) available in general market to obtain a non-fixed reproduced image. The image is then fixed by passing the same through image fixing rollers applied with a linear pressure of 15 kg/cm. A clear image with excellent reproducibility of thin lines is obtained, with good image fixing property.

I claim:

1. Porous toner which comprises a coloring matter and a binder, said toner being formed by obtaining a powder through a step of mixing and kneading under heat a toner preparing material including a coloring matter, a binder and an elimination compound having a particle size from 0.01–20 microns which neither softens nor melts at a temperature at which said binder softens or melts, and by treating said powder with a solvent to remove said elimination compound to thereby form irregular shaped particles having voids or pores from 0.01 to 20 microns in diameter in the surface and interior thereof.

2. Porous toner as set forth in claim 1, wherein said toner preparing material includes magnetic powder.

3. Porous toner as set forth in claim 1, wherein said binder consists of a pressure fixable component.

4. Porous toner as set forth in claim 3, wherein said pressure fixable component is selected from ethylene type polymers having a melt-viscosity of from 10 to $10^6$ cps at 140° C.

5. Porous toner as set forth in claim 1, wherein said elimination compound is contained in said toner components at a rate of from 10 to 90% by weight.

6. Porous toner as set forth in claim 1, wherein said solvent is an organic solvent.

7. Porous toner as set forth in claim 1, wherein said solvent is water.

8. Porous toner which comprises a coloring matter and a binder, said toner being formed by mixing and kneading under heat a toner preparing material including a coloring matter, a binder and an elimination compound having a particle size from 0.01–20 microns which neither softens nor melts at a temperature at which said binder softens or melts, then finely dividing the mixture to form powder and thereafter applying heat treatment to the powder, followed by treating the powder with the solvent to remove said elimination compound to thereby form irregular shaped particles having voids or pores from 0.01 to 20 microns in diameter in the surface and interior thereof.

9. Porous toner which comprises a coloring matter and a binder, said toner being formed by mixing and kneading under heat a toner preparing material including a coloring matter, a binder and an elimination compound having a particle size from 0.01 to 20 microns which neither softens nor melts at a temperature at which said binder softens or melts, then finely dividing the mixture to form powder, and treating the powder with a solvent to remove said elimination compound, followed by applying heat treatment to the powder to thereby form irregular shaped particles having voids or pores from 0.1 to 20 microns in diameter in the surface and interior thereof.

10. A process for preparing a porous toner which comprises forming a powder through a step of mixing and kneading under heat a toner preparing material including a coloring matter, a binder and an elimination compound which neither softens nor melts at a temperature at which said binder softens or melts, and treating said powder with a solvent to remove said elimination compound.

11. A process for preparing a porous toner which comprises mixing and kneading under heat a toner preparing material including a coloring matter, a binder and an elimination compound which neither softens nor melts at a temperature at which said binder softens or melts, then finely dividing the mixture to form powder, and thereafter applying heat treatment to the powder, followed by treating the powder with a solvent to remove said elimination compound.

12. A process for preparing a porous toner which comprises mixing and kneading under heat a toner preparing material including a coloring matter, a binder and an elimination compound which neither softens nor melts at a temperature at which said binder solftens or melts, then finely dividing the mixture to form powder, and treating the powder with a solvent to remove said elimination compound, followed by applying heat treatment to the powder.

* * * * *